US006858825B1

(12) United States Patent
Ruffa

(10) Patent No.: US 6,858,825 B1
(45) Date of Patent: Feb. 22, 2005

(54) DEVICE AND METHOD FOR PREVENTING SUPERHEATING OF LIQUIDS IN A MICROWAVE OVEN

(75) Inventor: Anthony A. Ruffa, Hope Valley, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/730,186

(22) Filed: Dec. 8, 2003

(51) Int. Cl.[7] ..... H05B 6/64
(52) U.S. Cl. ..... 219/706; 219/756
(58) Field of Search ..... 219/706, 756, 219/702, 704, 725, 719, 731, 682, 759, 712, 679, 680, 732, 733, 735, 705, 694, 796, 688, 687; 366/22, 127, 108, 147; 261/139, DIG. 48, DIG. 55; 122/6 A; 165/81; 236/20 R

(56) References Cited

U.S. PATENT DOCUMENTS

| | | | | |
|---|---|---|---|---|
| 2,757,869 A | | 8/1956 | Ray | |
| 4,563,313 A | * | 1/1986 | Tsuaki | 261/81 |
| 4,868,357 A | | 9/1989 | Serikawa et al. | |
| 4,869,233 A | | 9/1989 | Stulen et al. | |
| 4,996,403 A | | 2/1991 | White | |
| 4,998,001 A | | 3/1991 | Cigarini et al. | |
| 5,036,172 A | | 7/1991 | Kokkeler et al. | |
| 5,786,579 A | | 7/1998 | Park | |
| 6,236,025 B1 | | 5/2001 | Berkcan et al. | |
| 6,268,596 B1 | * | 7/2001 | Lauf et al. | 219/687 |
| 6,301,521 B1 | | 10/2001 | Chen et al. | |
| 2001/0030295 A1 | | 10/2001 | Holl | |

FOREIGN PATENT DOCUMENTS

JP 08171987 A * 7/1996 ..... H05B/6/78

OTHER PUBLICATIONS

BJP Mortimer, et al., The Development of an Ultrasonic Humidifier for Domestic Applications, paper, 1999, ppg. 138–141, Centre for Instrumentation, Cape Technikon.

* cited by examiner

*Primary Examiner*—Quang T. Van
(74) *Attorney, Agent, or Firm*—James M. Kasischke; Michael P. Stanley; Jean-Paul A. Nasser

(57) ABSTRACT

A safety device for reducing the likelihood of superheating a liquid includes a transducer disposed on a support surface proximate to a placed container containing a liquid. The transducer generates a vibrational force in the container and onto the liquid that creates nucleation within the liquid. The nucleation allows the liquid to boil, thus preventing the liquid from becoming superheated.

3 Claims, 1 Drawing Sheet

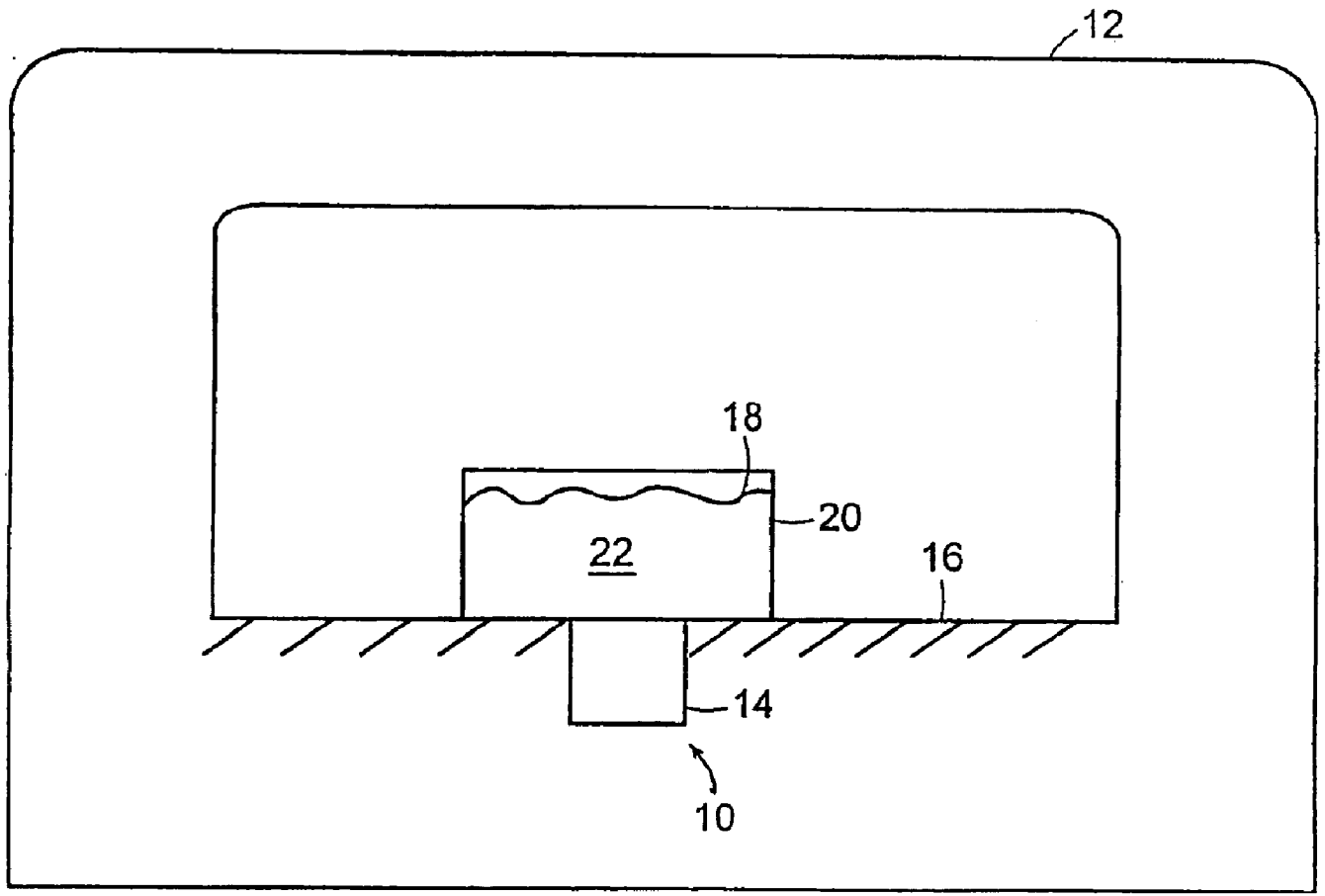
FIGURE

DEVICE AND METHOD FOR PREVENTING SUPERHEATING OF LIQUIDS IN A MICROWAVE OVEN

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to microwave ovens, and in particular relates to a device and method of use to prevent superheating of liquid during heating within the microwave oven.

(2) Description of the Prior Art

Microwave ovens are commonly used to heat foods, beverages, and the like by people of all ages and intelligences. Unknown to the general public, heating liquids in a microwave oven can create a very dangerous condition. For example, if the water contained in a new or very smooth cup or bowl (e.g., one that does not have any scratches to initiate boiling) is brought to a temperature of 100° C. or greater in a microwave, it can be brought to a superheated (metastable) state.

Superheating takes place when a substance is heated above the temperature at which a change of state would ordinarily take place without such a change of state occurring, for example, the heating of a liquid above its boiling point without boiling taking place. When this superheated state is disturbed, a large amount of water can vaporize at once, causing the liquid to "explode" into the face of the person taking the cup or bowl out of the microwave resulting in first and second degree burns to the person.

Burn injuries from microwave use are not uncommon and are familiar to emergency room physicians. Presently, microwaves have no apparent indications to warn a person that a liquid is in a superheated condition. While precautions exist that can be taken to avoid creating a superheated condition, these precautions (and the condition itself) are not well known by the general public.

In view of the above, it is therefore desirable to have a device that reduces the likelihood of liquid superheating while being easy to use by the general public.

SUMMARY OF THE INVENTION

Accordingly, it is a general purpose and primary object of the present invention to provide a device that reduces the likelihood of liquid superheating.

It is a further object of the present invention to provide a device adaptable for a microwave oven and easy to use by the general public.

A safety device according to the present invention includes a transducer disposed on a support surface. The support surface is adapted to support a container containing a liquid within a microwave oven. The transducer prevents the liquid from becoming superheated by vibrating the support surface such that the liquid within the container nucleates, thus allowing the liquid to boil.

In a preferred embodiment, the transducer is embedded within or secured to the support surface. Alternatively, the support surface may be either an integral element or removable element of the microwave oven. The transducer may be powered from a power source powering the microwave oven. The transducer may be powered by a pulsed impulse function, or driven in a sinusoidal mode and preferably operates at ultrasonic frequencies.

BRIEF DESCRIPTION OF THE DRAWINGS

These and other features and advantages of the present invention will be better understood in view of the following description of the invention taken together with the drawing (s) wherein:

FIG. 1 is a schematic view of the safety device according to the present invention.

DESCRIPTION OF THE PREFERRED EMBODIMENT

Referring now to the drawing wherein like numerals refer to like elements, one sees that FIG. 1 depicts a safety device 10 according to the present invention with the safety device designed to be used with a microwave oven 12. The safety device 10 generally includes a transducer 14 positioned in a support surface 16 within the microwave oven 12.

In operation, the transducer 14 creates a vibrational force of a sufficient amplitude to cause standing waves in the surface 18 of a container 20 containing a liquid 22, for example, but not limited to water. The waves generated by the transducer 14 create nucleation sites for the liquid 22, thus allowing the liquid to boil. By boiling, a superheated state is avoided for the liquid 22.

The support surface 16 of a type known to those skilled in the art within the microwave oven 12 is sufficiently rigid to allow vibrations generated by the transducer 14 to propagate throughout the entire support surface with a negligible decrease in amplitude. The standing waves generated by the transducer 14 are of sufficient amplitude to dissipate or shock the liquid 22 out of a superheated state. When breaking waves occur on the surface 1B, this breaking wave action provides nucleation sites.

Standing waves of much less amplitude may be sufficient. High amplitude ultrasonic energy will produce cavitation even under normal conditions. When the liquid is in a metastable state to begin with, the amplitude needed to induce cavitations will be greatly reduced.

The transducer 14 may be any device capable of generating a vibrational force sufficient to cause nucleation of the liquid 22 within the container 20. The transducer 14 may be powered using a power source (not shown) that powers the microwave oven 12.

The transducer 14 may operate in several different modes, in that the transducer may create the vibrational force randomly, continuously, or periodically. For example, the transducer 14 may be powered by pulsed impulse functions with sufficient amplitude to shock the liquid 22. Alternatively, the transducer 14 may driven in a sinusoidal mode, but at ultrasonic frequencies, so that the standing waves would have very small wavelengths.

The transducer 14 may be activated manually, but is preferably automatically operated once the microwave oven 12 is activated. A timer (not shown) may also be used to activate the transducer 14 after a preset amount of time in the event that the container 20 is left within the microwave oven 12 after the microwave oven has finished heating the liquid 22.

In the preferred embodiment, shown in FIG. 1, the transducer 14 is embedded within or secured to the support surface 16. Alternatively, the support surface 16 may be an integral part or a removable element of the microwave oven 12.

Accordingly, the safety device 10 creates waves within the liquid 22. The waves create nucleation sites that allow the liquid 22 to safely boil and avoid becoming superheated. The device is easy to operate, thus making the microwave oven 12 safer for general use.

In light of the above, it is therefore understood that within the scope of the appended claims, the invention may be practiced otherwise than as specifically described.

What is claimed is:

1. A device to prevent superheating of a liquid within a microwave oven, said device comprising:

a transducer positionable on a surface within the microwave oven wherein the surface supports a container for the liquid, said transducer responsive to a source of energy such that said transducer vibrates the surface thereby nucleating and allowing the liquid to boil such that the liquid is prevented from superheating; and wherein said transducer is capable of being energized by a pulsed impulse with sufficient amplitude to boil the liquid.

2. The device in accordance with claim 1 wherein said transducer is capable of being embedded within the surface of the microwave oven.

3. The device in accordance with claim 2 wherein said transducer is capable of being energized by a source of energy powering the microwave oven.

* * * * *